US012111056B2

(12) United States Patent
Xu

(10) Patent No.: US 12,111,056 B2
(45) Date of Patent: Oct. 8, 2024

(54) COMBUSTOR WITH CENTRAL FUEL INJECTION AND DOWNSTREAM AIR MIXING

(71) Applicant: Pratt & Whitney Canada Corp., Longueuil (CA)

(72) Inventor: Hang Xu, Oakville (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 18/104,990

(22) Filed: Feb. 2, 2023

(65) Prior Publication Data

US 2024/0263788 A1 Aug. 8, 2024

(51) Int. Cl.
*F23R 3/28* (2006.01)

(52) U.S. Cl.
CPC .... *F23R 3/286* (2013.01); *F23R 2900/00002* (2013.01)

(58) Field of Classification Search
CPC .. F23R 3/286; F23R 3/14; F23R 3/343; F23R 3/36; F23R 3/28; F23R 3/06; F23R 3/10; F02C 7/22; F05D 2240/35; F23D 17/002
See application file for complete search history.

(56) References Cited

U.S. PATENT DOCUMENTS 4,070,826 A * 1/1978 Stenger ..... F23D 11/106 239/425
5,404,711 A * 4/1995 Rajput ..... F23L 7/002 60/737
5,488,829 A * 2/1996 Southall ..... F23R 3/12 60/725
5,836,163 A * 11/1998 Lockyer ..... F23D 17/002 60/737
6,247,317 B1 * 6/2001 Kostka ..... F23C 7/02 60/741

(Continued)

FOREIGN PATENT DOCUMENTS

CN 101220955 7/2008
CN 206113000 4/2017

(Continued)

OTHER PUBLICATIONS

European Search Report for EP Application No. 24155584.6 dated May 13, 2024.

*Primary Examiner* — Craig Kim
(74) *Attorney, Agent, or Firm* — Carlson, Gaskey & Olds, P.C.

(57) ABSTRACT

A combustor has a mixing body with a central fuel passage with a central axis and adapted to be connected to source of fuel. A nose at a forward end includes a plurality of fuel injection passages allowing fuel to flow from the central fuel passage into an area forward of an outlet from the fuel injection passages. An inner air supply radially outwardly of the central fuel passage delivers air into inner slots extending downstream of outlets of the fuel injection passages such that air and fuel can begin to be mixed and move downstream of an end of the nose. An outer air supply delivers air downstream of the inner air outlet such that air from the outer air supply, air from the inner slots and fuel from the fuel injection passages are all driven forwardly into a combustion chamber. A gas turbine engine is also disclosed.

20 Claims, 2 Drawing Sheets

(56) References Cited

U.S. PATENT DOCUMENTS 6,405,523 B1 * 6/2002 Foust ..... F23R 3/14 60/776
6,865,889 B2 * 3/2005 Mancini ..... F23R 3/16 60/737
7,117,678 B2 10/2006 Sampath et al.
7,762,070 B2 7/2010 Dawson et al.
7,762,073 B2 * 7/2010 Li ..... F23R 3/14 60/737
7,832,212 B2 11/2010 Bunker
7,870,736 B2 1/2011 Homitz et al.
8,266,911 B2 9/2012 Evulet
8,413,445 B2 4/2013 Poyyapakkam
8,539,773 B2 9/2013 Ziminsky et al.
8,661,779 B2 3/2014 Laster et al.
8,893,500 B2 * 11/2014 Oskam ..... F23D 11/103 60/737
8,973,367 B2 * 3/2015 Bottcher ..... F23R 3/283 60/742
9,771,869 B2 9/2017 Li et al.
9,909,597 B2 * 3/2018 Dickson ..... F04D 29/706
9,951,955 B2 * 4/2018 Sandelis ..... F23R 3/283
9,976,522 B2 5/2018 Patel et al.
10,082,294 B2 9/2018 Laster et al.
10,267,522 B2 4/2019 Ciani et al.
10,502,425 B2 12/2019 Boardman et al.
10,704,786 B2 7/2020 Laster et al.
10,865,989 B2 12/2020 Sadasivuni
10,941,940 B2 3/2021 Bulat et al.
11,041,624 B2 * 6/2021 Witham ..... F23D 11/383
11,067,280 B2 7/2021 Boardman et al.
11,149,952 B2 * 10/2021 Dai ..... F23R 3/286
11,175,045 B2 * 11/2021 Benjamin ..... F23R 3/28
11,692,709 B2 * 7/2023 Naik ..... F23R 3/12 60/737
2004/0020211 A1 * 2/2004 Kendrick ..... F23R 3/28 60/750
2007/0003897 A1 1/2007 Koizumi et al.
2008/0236165 A1 * 10/2008 Baudoin ..... F23R 3/343 60/746
2009/0049840 A1 * 2/2009 Cayre ..... F23R 3/14 60/737
2009/0113895 A1 * 5/2009 Steele ..... F23R 3/286 60/737
2010/0300102 A1 * 12/2010 Bathina ..... F23R 3/12 60/737
2011/0061395 A1 * 3/2011 Kendrick ..... F23R 3/346 60/772
2011/0185703 A1 8/2011 Dodo et al.
2011/0271682 A1 * 11/2011 Sandelis ..... F23C 7/004 60/737
2012/0131925 A1 * 5/2012 Mittricker ..... F23R 3/06 60/39.23
2012/0192565 A1 8/2012 Tretyakov et al.
2012/0227411 A1 9/2012 Carroni et al.
2016/0281991 A1 * 9/2016 Rullaud ..... F02C 7/22
2017/0204785 A1 * 7/2017 Ramier ..... F02C 7/22
2017/0227224 A1 8/2017 Oskam et al.
2017/0298817 A1 * 10/2017 Horiuchi ..... F02C 7/16
2017/0299190 A1 * 10/2017 Patel ..... F02C 7/22
2017/0307210 A1 10/2017 Hirano et al.
2017/0350598 A1 * 12/2017 Boardman ..... F23R 3/14
2018/0023812 A1 * 1/2018 Laster ..... F23R 3/36 239/418
2018/0051883 A1 * 2/2018 Meadows ..... F23R 3/286
2018/0313542 A1 * 11/2018 Leparoux ..... F23R 3/286
2019/0257520 A1 * 8/2019 Tibbs ..... F23R 3/14
2021/0095599 A1 * 4/2021 Asai ..... F02C 7/228
2021/0172413 A1 6/2021 Snyder
2022/0003414 A1 * 1/2022 Chen ..... F23R 3/12
2022/0113024 A1 * 4/2022 Chabaille ..... F23R 3/286
2022/0268444 A1 * 8/2022 D'Agostini ..... F23R 3/36
2022/0395677 A1 * 12/2022 Kim ..... A61M 1/77
2023/0065831 A1 * 3/2023 Oskam ..... F02C 7/222
2023/0204213 A1 * 6/2023 Naik ..... F23R 3/14 60/748
2024/0009733 A1 * 1/2024 Antony ..... F23R 3/002

FOREIGN PATENT DOCUMENTS

EP 1923637 5/2008
EP 3209941 B1 8/2020
GB 2585025 A 12/2020
JP 2013108667 6/2013
JP 5538113 7/2014
JP 5926635 5/2016
WO 00/19146 A2 4/2000
WO 2016051756 4/2016
WO 2020259919 12/2020

* cited by examiner

COMBUSTOR WITH CENTRAL FUEL INJECTION AND DOWNSTREAM AIR MIXING

BACKGROUND

This application relates to a combustor for use in a gas turbine engine having central fuel injection and radially outer air injection.

Gas turbine engines are known, and typically include a compressor delivering compressed air into a combustor. Compressed air is mixed with fuel and ignited. Products of the combustion pass downstream over turbine rotors, driving them to rotate. The turbine rotors in turn rotate the compressor rotor and a propulsor rotor such as a fan or propeller.

Historically, aviation fuel has been utilized with gas turbine engines, especially for aircraft applications. More recently it has been proposed to utilize hydrogen ($H_2$) as a fuel.

SUMMARY

A combustor for a gas turbine engine includes a liner receiving a fuel and air mixing body. The mixing body has a central fuel passage with a central axis and adapted to be connected to source of fuel. A nose at a forward end of the central fuel passage includes a plurality of fuel injection passages allowing fuel to flow from the central fuel passage into an area forward of an outlet from the fuel injection passages. An inner air supply is radially outwardly of the central fuel passage to deliver air into inner slots extending downstream of the outlets of the fuel injection passages to an inner slot outlet such that air and fuel can begin to be mixed and move downstream of an end of the nose. An outer air supply delivers air downstream of the inner air outlet such that air from the outer air supply, air from the inner slots and fuel from the fuel injection passages are all driven forwardly into a combustion chamber.

These and other features will be best understood from the following drawings and specification, the following is a brief description.

DETAILED DESCRIPTION

Figure 1:
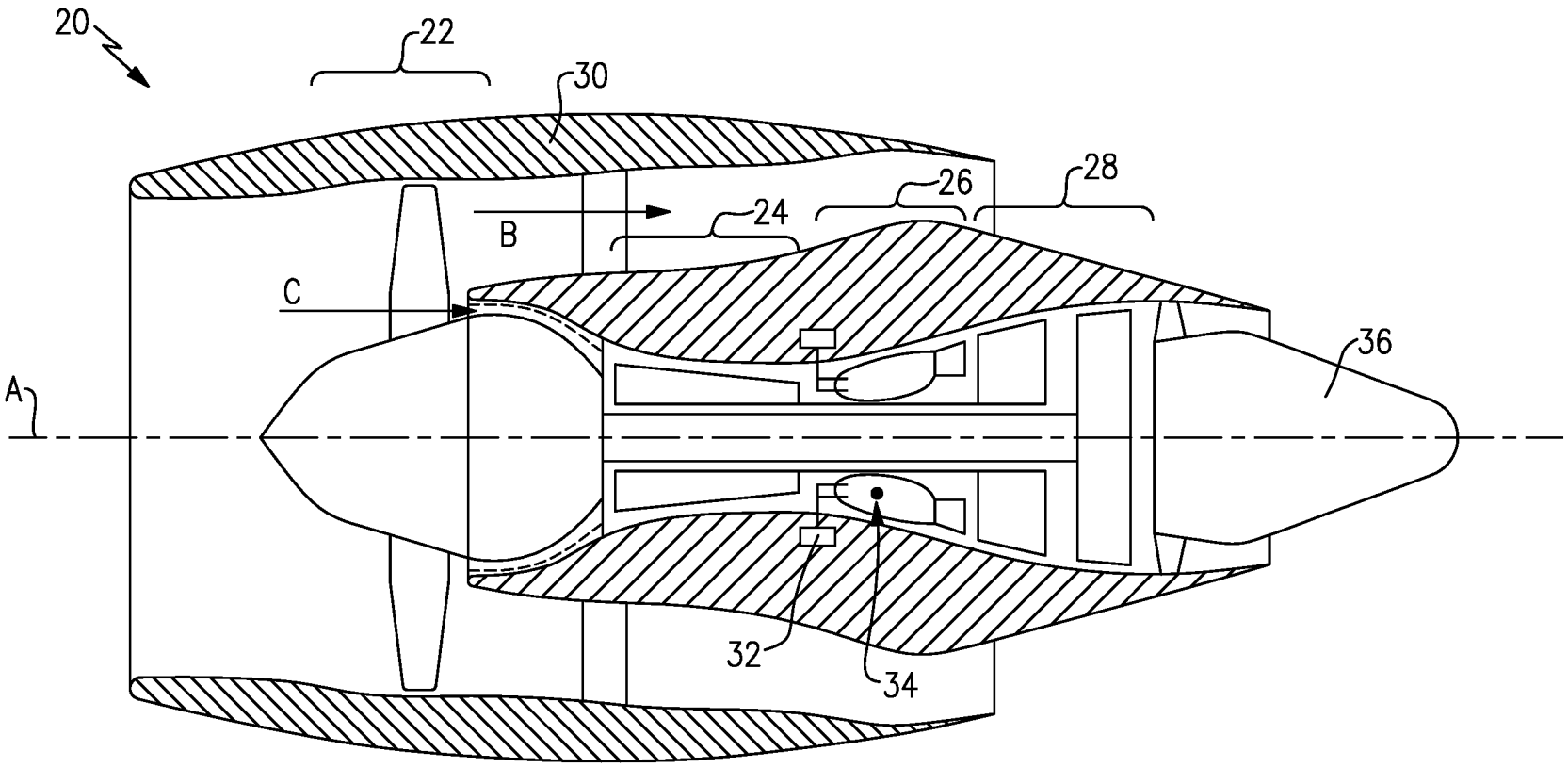
FIG. 1 schematically shows a gas turbine engine.

FIG. 1 schematically illustrates a gas turbine engine 20. The example gas turbine engine 20 is a turbofan that generally incorporates a fan section 22, a compressor section 24, a combustor section 26 and a turbine section 28. The fan section 22 drives air along a bypass flow path B in a bypass duct defined within a nacelle 30. The turbine engine 20 intakes air along a core flow path C into the compressor section 24 for compression and communication into the combustor section 26. In the combustor section 26, the compressed air is mixed with fuel from a fuel system 32 and ignited by igniter 34 to generate an exhaust gas flow that expands through the turbine section 28 and is exhausted through exhaust nozzle 36. Although depicted as a turbofan turbine engine in the disclosed non-limiting embodiment, it should be understood that the concepts described herein are not limited to use with turbofans as the teachings may be applied to other types of turbine engines. As one example, rather than having the propulsor be an enclosed fan, the propulsor may be an open propeller.

A gas turbine engine as disclosed in this application will utilize hydrogen ($H_2$) as a fuel. Challenges are faced by the use of hydrogen, and in particular combustor structure which might be appropriate for aviation fuel may not be as applicable to hydrogen as a fuel.

One challenge when utilizing hydrogen as a fuel is that it is in a gaseous state and more readily flammable than aviation fuel. This could raise challenges with burn back if ignitions starts too close to the fuel feed.

Figure 2A:
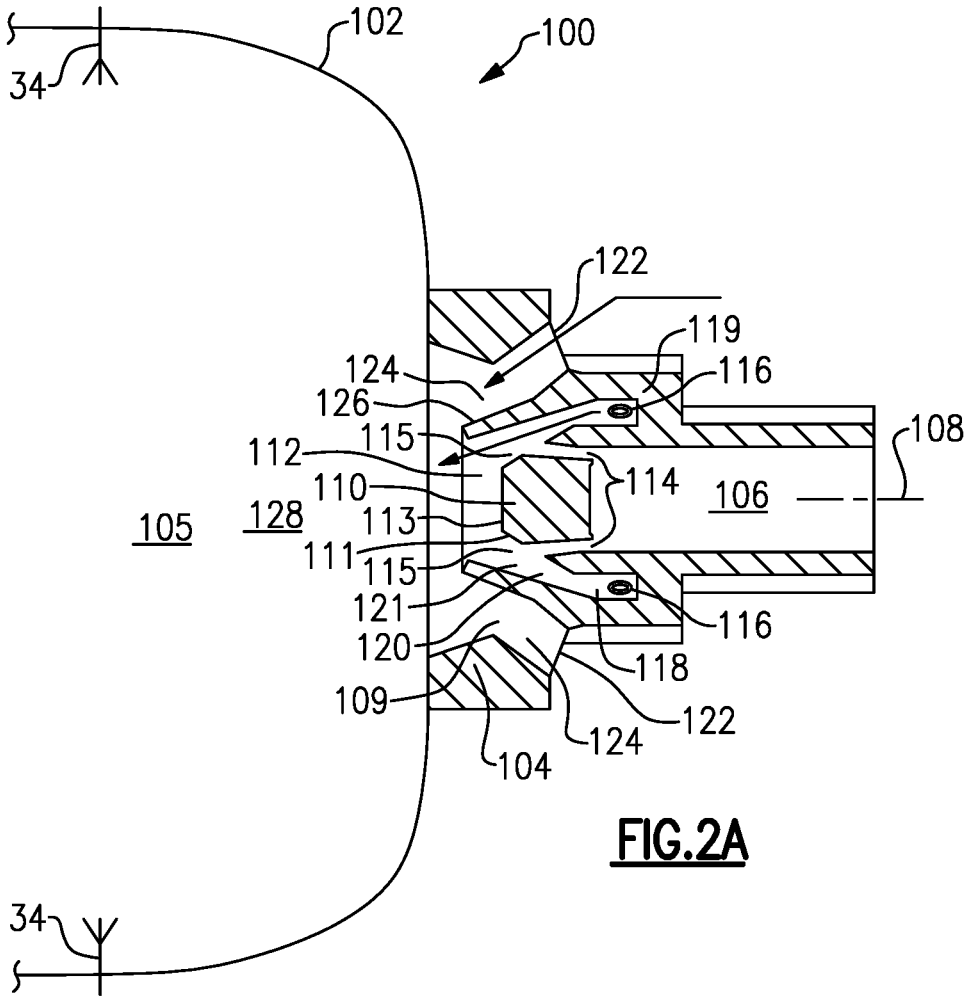
FIG. 2A is a cross-sectional view of a portion of a combustor.

FIG. 2A shows a combustor 100 having a liner 102 surrounding a fuel and air mixing body 104 and defining a combustion chamber 105. The liner 102 is only shown partially. Ignitors 34 are shown schematically.

Fuel is delivered into a central supply passage 106 having a center axis 108. A nose 110 is positioned forwardly of the central supply passage 106 and centered on the axis 108. Fuel injection passages 114 are spaced circumferentially about the center axis 108, and deliver fuel through outlets 115 downwardly of a nose 110 into an area 112 which is radially inward of a plurality of slots 118/120.

Air is delivered through holes 116 in an outer sleeve 119 of mixing body 104, and into a slot portion 118 which extends generally parallel to the axis 108. That air then moves into a slot portion 120 where it moves along a forward face 113 of the nose 110 and through outlets 109 along an area 121 forward of an outlet 115 of the fuel injection passages 114. The fuel and air thus begin to mix at this point, and move into the area 112. That is, air in slot 120 moves radially inwardly and across the fuel outlets 115.

Outer air is delivered into openings 122 in mixing body 104 and a slot 124 which is radially outward of slots 120. That outer air moves along a radially inwardly extending surface 126 of the nose 110. This outer air drives the mixed fuel and air from area 112 into an area 128 where the flame may begin. In this manner, the area 128 where the flame will begin is moved downstream away from the central fuel passage 106. The risk of flame back is thus reduced.

Figure 2B:
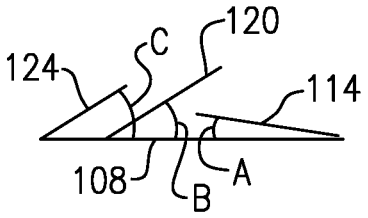
FIG. 2B shows a directional detail of the FIG. 2A embodiment.

FIG. 2B shows a directional detail of the direction of the fuel injection passages 114 which extend radially away from axis 108 at an angle A. The slots 120 extend at an angle B radially toward the axis 108. The slots 124 extend along the portion 126 of the nose extend toward the axis 108 an angle C. As can be seen from FIG. 2A.

Figure 2C:
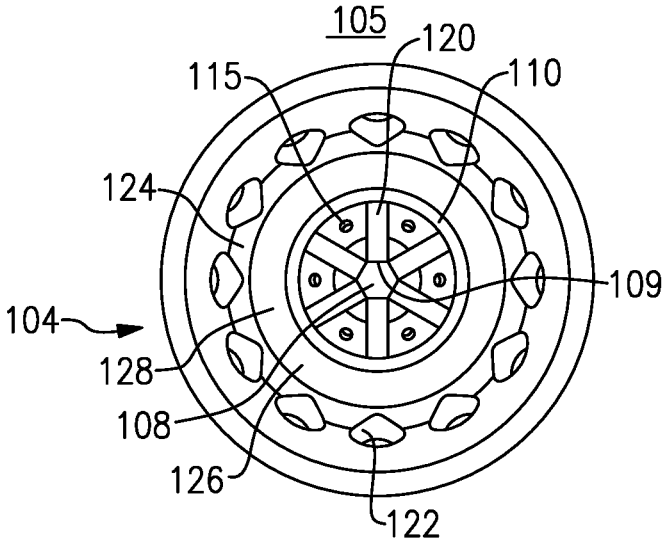
FIG. 2C is a view of the FIG. 2A embodiment looking into a mixing body.

FIG. 2C shows the slots or passages 120 are circumferentially intermediate the fuel outlets 115. There are a plurality of slots 120 and an equal number of fuel injection passages 114. In this embodiment, there are six of each, however, other numbers can of course be utilized.

The slot passage 124 can be seen to be circumferentially continuous.

Now, the fuel and air will be readily mixed and moved toward the area 128 of the combustion chamber 105, and sufficiently downstream of the fuel outlets 115 to reduce the risk of burn back.

In a featured embodiment. a combustor 100 for a gas turbine engine under this disclosure could be said to include a liner 102 receiving a fuel and air mixing body 104. The mixing body has a central fuel passage 106 with a central axis 108 and adapted to be connected to source of fuel. A nose 110 at a forward end of the central fuel passage includes a plurality of fuel injection passages 114 allowing fuel to flow from the fuel supply passage into an area 112 forward of an outlet 115 from the fuel injection passages. An inner air supply is radially outwardly of the central fuel passage to deliver air into inner slots 120 extending downstream of the outlets 115 of the fuel injection passages to an inner slot outlet such that air and fuel can begin to be mixed downstream of an end 113 of the nose. Air from slot 120 prevents recirculation zone formation at end of nose. An outer air supply delivers air downstream of the inner air outlet such that air from the outer air supply, air from the inner air slots and fuel from the fuel injection passages are all driven forwardly into a combustion chamber.

In another embodiment according to the previous embodiment, the source of fuel is a source of hydrogen.

In another embodiment according to any of the previous embodiments, the fuel passages extend from a fuel supply through outlets with an angle A having a component in an axially outward direction and with a radially inward component toward the center axis.

In another embodiment according to any of the previous embodiments, the outer air passages include a plurality of outer air passages 122 intermediate each of the inner air swirler passages 120.

In another embodiment according to any of the previous embodiments, the outer air passages include a plurality of outer air passages 122 intermediate each of the inner air swirler passages 120.

In another embodiment according to any of the previous embodiments, a concentration of air in the inner chamber increases from the central axis to an inner wall defining the inner chamber, and a concentration of fuel in the inner chamber increases from the inner wall to the central axis.

In another embodiment according to any of the previous embodiments, the fuel passages extend from a fuel supply passage through outlets with an angle A having a component in an axially outward direction and with a radially inward component toward the center axis.

In another embodiment according to any of the previous embodiments, the outer air passages include a plurality of outer air passages 122 intermediate each of the inner air swirler passages 120.

In another embodiment according to any of the previous embodiments, the outer air passages include a plurality of outer air passages 122 intermediate each of the inner air swirler passages 120.

In another embodiment according to any of the previous embodiments, a concentration of air in the inner chamber increases from the central axis to an inner wall defining the inner chamber, and a concentration of fuel in the inner chamber increases from the inner wall to the central axis.

A gas turbine engine incorporating any of the above features is also disclosed and claimed.

Although embodiments have been disclosed, a worker of skill in this art would recognize that modifications would come within the scope of this disclosure. For that reason, the following claims should be studied to determine the true scope and content of this disclosure.

What is claimed is:

1. A combustor for a gas turbine engine comprising:

a liner receiving a fuel and air mixing body, the mixing body having a central fuel passage with a central axis and adapted to be connected to source of fuel, a nose at a forward end of the central fuel passage includes a plurality of fuel injection passages allowing fuel to flow from the central fuel passage into an area forward of an outlet from the fuel injection passages;

an inner air supply radially outwardly of the central fuel passage to deliver air into inner slots extending downstream of the outlets of the fuel injection passages to an inner slot outlet such that air and fuel can begin to be mixed and move downstream of an end of the nose, said inner air slots are circumferentially intermediate the outlets of the fuel injection passages, said inner slots outlet passing air across the outlets of the fuel injection passages; and an outer air supply delivering air downstream of the inner air outlet such that air from the outer air supply, air from the inner slots and fuel from the fuel injection passages are all driven forwardly into a combustion chamber.

2. The combustor as set forth in claim 1, wherein a fuel supply is connected to the fuel supply passage, and the fuel is hydrogen.

3. The combustor as set forth in claim 2, wherein the fuel injection passages extend at a first angle radially away from the central axis, the inner slots extend radially at a second angle towards the central axis, and the outer air supply including at least one outer slot that also extends radially at a third angle toward the central axis, all along an axially downstream direction.

4. The combustor as set forth in claim 3, wherein the at least one outer slot is a single circumferentially continuous slot.

5. The combustor as set forth in claim 3, wherein the inner slots are circumferentially intermediate separate ones of said outlets of the fuel passages.

6. The combustor as set forth in claim 2, wherein the inner slots are circumferentially intermediate separate ones of said outlets of the fuel passages.

7. The combustor as set forth in claim 2, wherein an outer sleeve is radially outward of the central fuel passage, and air supply holes extending through said outer sleeve and into the inner slots.

8. The combustor as set forth in claim 1, wherein the fuel injection passages extend at a first angle radially away from the central axis, the inner slots extend radially at a second angle towards the central axis, and the outer air supply includes at least one slot that also extends radially at a third angle toward the central axis, all along an axially downstream direction.

9. The combustor as set forth in claim 8, wherein the inner slots are circumferentially intermediate separate ones of said outlets of the fuel passages.

10. The combustor as set forth in claim 1, wherein the inner slots are circumferentially intermediate separate ones of said outlets of the fuel passages.

11. A gas turbine engine comprising:

a compressor section and a turbine section; and a combustor positioned intermediate said compressor section and said turbine section and having a liner receiving a fuel and air mixing body, the mixing body having a central fuel passage with a central axis and adapted to be connected to source of fuel, a nose at a forward end of the central fuel passage includes a plurality of fuel injection passages allowing fuel to flow from the central fuel passage into an area forward of an outlet from the fuel injection passages;

an inner air supply radially outwardly of the central fuel passage to deliver air into inner slots extending downstream of the outlets of the fuel injection passages to an inner slot outlet such that air and fuel can begin to be mixed and move downstream of an end of the nose, said inner air slots are circumferentially intermediate the outlets of the fuel injection passages, said inner slots outlet passing air across the outlets of the fuel injection passages; and an outer air supply delivering air downstream of the inner air outlet such that air from the outer air supply, air from the inner slots and fuel from the fuel injection passages are all driven forwardly into a combustion chamber.

12. The gas turbine engine as set forth in claim 11, wherein a fuel supply is connected to the fuel supply passage, and the fuel is hydrogen.

13. The gas turbine engine as set forth in claim 12, wherein the fuel injection passages extend at a first angle radially away from the central axis, the inner slots extend radially at a second angle towards the central axis, and the outer air supply including at least one outer slot that also extends radially at a third angle toward the central axis, all along an axially downstream direction.

14. The gas turbine engine as set forth in claim 13, wherein the at least one outer slot is a single circumferentially continuous slot.

15. The gas turbine engine as set forth in claim 14, wherein the inner slots are circumferentially intermediate separate ones of said outlets of the fuel passages.

16. The gas turbine engine as set forth in claim 12, wherein the inner slots are circumferentially intermediate separate ones of said outlets of the fuel passages.

17. The gas turbine engine as set forth in claim 12, wherein an outer sleeve is radially outward of the central fuel passage, and air supply holes extending through said outer sleeve and into the inner slots.

18. The gas turbine engine as set forth in claim 11, wherein the fuel injection passages extend at a first angle radially away from the central axis, the inner slots extend radially at a second angle towards the central axis, and the outer air supply includes at least one slot that also extends radially at a third angle toward the central axis, all along an axially downstream direction.

19. The gas turbine engine as set forth in claim 18, wherein the inner slots are circumferentially intermediate separate ones of said outlets of the fuel passages.

20. The gas turbine engine as set forth in claim 11, wherein the inner slots are circumferentially intermediate separate ones of said outlets of the fuel passages.

* * * * *